United States Patent [19]

Lohr

[11] 3,951,425

[45] Apr. 20, 1976

[54] ANTI-CROSSING DEVICE FOR SKIS

[75] Inventor: Margaretha Lohr, Lampersbach, Austria

[73] Assignee: Margaretha Lohr, Werfenweng, Austria

[22] Filed: Mar. 10, 1975

[21] Appl. No.: 556,959

[30] Foreign Application Priority Data

Mar. 11, 1974 Austria ..... 1986/74

[52] U.S. Cl. ..... 280/11.37 E

[51] Int. Cl.[2] ..... A63C 11/00

[58] Field of Search ..... 280/11.37 E, 11.13 T, 280/11.13 B, 11.13 C

[56] References Cited

UNITED STATES PATENTS

| | | | |
|---|---|---|---|
| 2,316,252 | 4/1943 | Karlsson | 280/11.13 C |
| 3,044,566 | 7/1962 | Mayr | 280/11.13 T |
| 3,148,891 | 9/1964 | Heuvel | 280/11.37 E |
| 3,761,106 | 9/1973 | Schwarz | 280/11.37 E |
| 3,863,943 | 2/1975 | Giannotti | 280/11.37 E |

FOREIGN PATENTS OR APPLICATIONS

| | | | |
|---|---|---|---|
| 443,499 | 4/1927 | Germany | 280/11.13 B |

*Primary Examiner*—M. H. Wood, Jr.
*Assistant Examiner*—Milton L. Smith
*Attorney, Agent, or Firm*—Woodhams, Blanchard and Flynn

[57] ABSTRACT

A device mounted on the upper surface of a ski between the toe binding and the tip of the ski to prevent the crossing of the skis. The device is composed of an inverted U-shaped member which is pivotally secured to a bearing element mounted on the upper surface of the ski. A locking device is provided to lock the inverted U-shaped bar member into a position generally perpendicular to the upper surface of the ski and in a position which is generally parallel to the upper surface of the ski.

12 Claims, 8 Drawing Figures

ANTI-CROSSING DEVICE FOR SKIS

FIELD OF THE INVENTION

The invention relates to a ski having a member arranged on the front part of its upper surface.

BACKGROUND OF THE INVENTION

The danger exists during skiing, that the ski tips cross, which can lead to dangerous falls. It has already been suggested, to arrange devices on the ski between the toe binding and the tip of the ski, which prevent the crossing of the ski tips. These devices are mainly made of plastic and are rigid, truncated-cone-shaped members, which are substantially rigidly connected to the upper surface of the ski. However, a number of disadvantages result thereby. For example, during a sudden penetration of the ski into hard, packed snow or heavy old snow, a dangerous braking action occurs. Since the members project substantially above the upper surface of the ski, an additional danger of injury is created during falls. Furthermore, the deflecting members are hindrance during transport.

In a different known embodiment, the deflecting members can be released from the ski after removal of a locking device, however, the problem of transporting the bulky and big members still remains. Therefore, in general, these members are only removed during a long pause in skiing, such as for a trip.

Therefore, the purpose of the invention is to avoid these disadvantages and to produce a suitable member, which is practically rigid in transverse direction of the ski and thus prevents a crossing of the tips of the ski, which however, gives or flexes during an excessive pressure occurring substantially in longitudinal direction of the ski and may remain on the ski during transport of the ski without being cumbersome.

This purpose is attained by making the member a bar which is arranged transversely to the longitudinal direction of the ski and which bar is held in position by a locking device.

Thus, in the position of use, the bar projects approximately vertically upwardly and is held in this position by the locking device. If, as already mentioned, an excessive pressure occurs, then the bar is moved to a flat position on the upper side of the ski by releasing the locking device. This position can also be effected voluntarily for transporting the skis.

BRIEF DESCRIPTION OF THE DRAWINGS

The subject matter of the invention is illustrated in various exemplary embodiments in the drawings, in which.

DETAILED DESCRIPTION

Figure 1:
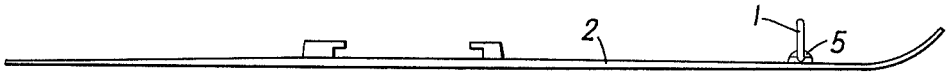
FIG. 1 is a side view of a complete ski having the inventive bar.

As one can recognize from FIG. 1, a bar 1 is arranged on the front area of the ski 2 between the binding parts and the tip of the ski. According to FIGS. 2 to 4, the bar 1 has inwardly bent ends 3, which are pivotally received in recesses 4 in the bearing elements 5. The bearing elements 5 have, in the exemplary embodiment, a semicircular cross section and can be secured on the ski by an adhesive, screws or the like. Locking recesses 6, 7 are provided on the outside surfaces of the bearing elements 5, which locking recesses extend radially with respect to the bearing recesses 4. The resilient legs of the bar 1 are received in the locking recesses 6, 7. The bar 1 may either be formed self-resiliently, for example made of a spring steel wire, or a coil spring 8, as indicated by a dash-dotted line, is connected to the legs of the bar 1.

Figure 2:
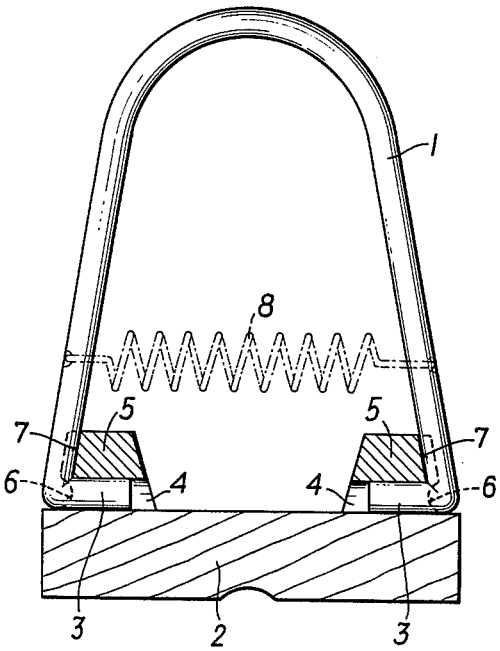
FIG. 2 illustrates a vertically positioned bar in a cross section through the bearing.
Figure 3:
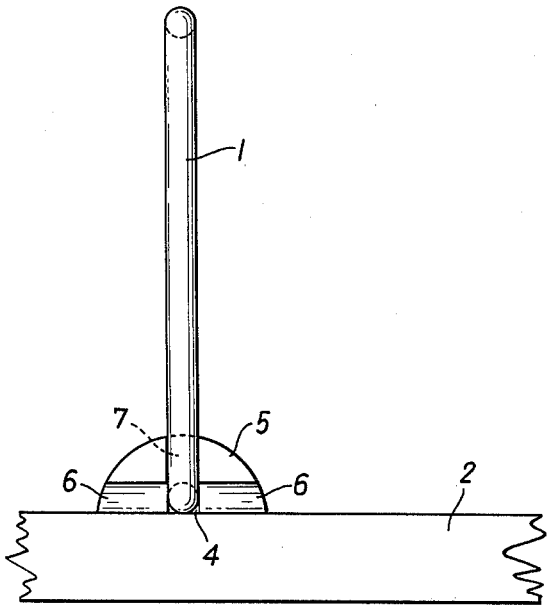
FIG. 3 is a side-elevational view of FIG. 2.
Figure 4:
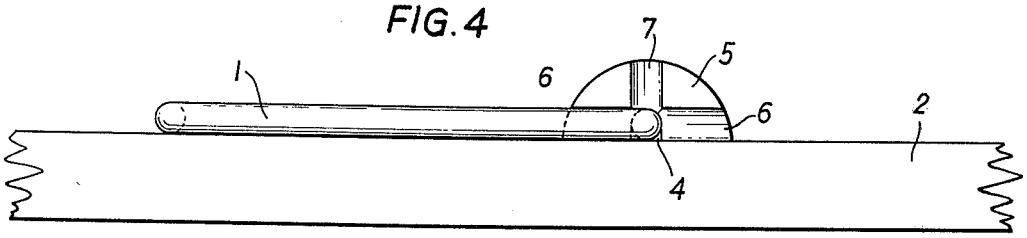
FIG. 4 is the same view as FIG. 3 with the bar resting on the surface of the ski.

In the position of use, as can be seen from FIGS. 2 and 3, when the bar projects vertically upwardly, a crossing of the skis, as already mentioned, is prevented. To transport the skis, the bar is laid over, so that said bar, as shown in FIG. 4, rests on the upper surface of the ski. The bar is pivoted about its bent ends 3 which form the pivot axis. The legs of the bar 1 exit from the locking recesses 7 against the resilient force and snap practically at the end of the pivoting movement into the locking recesses 6. In this construction, it is possible to swing the bar both forwardly and also backwardly, whereby it is releasably held in the locking recesses 6 in each one of these two pivoted positions and in a position parallel to the upper surface of the ski 2.

Figure 5:
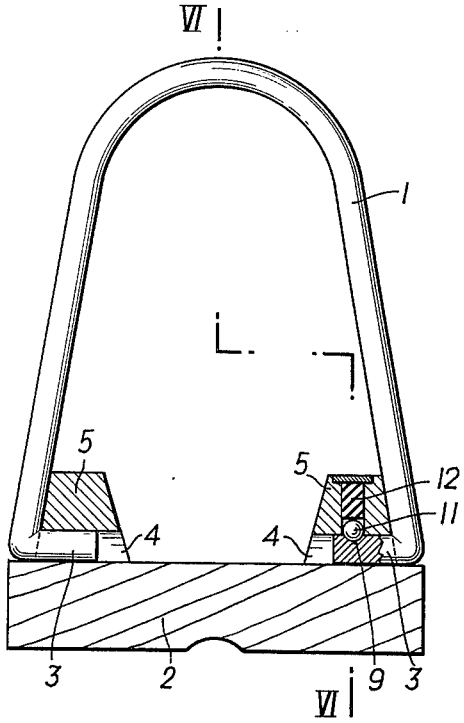
FIGS. 5 and 6 are associated views each in cross section of a different possibility of construction.
Figure 6:
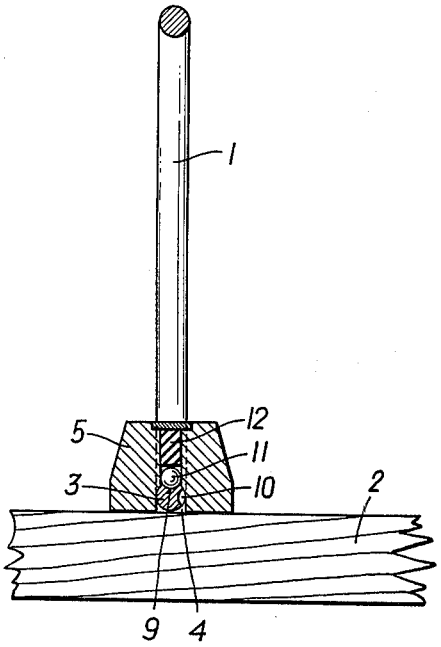

In the construction according to FIGS. 5 and 6, the bar 1 has bent ends 3 received in bearing recesses 4 in the bearing elements 5. A bent end of the bar has two locking recesses 9, 10 therein, into which alternately a locking detent member or ball 11 can engage. The locking ball 11 is movably supported in one of the bearing elements 5 against the force of a spring 12. It is possible to use both a rubber buffer, like in the exemplary embodiment, and also a coil spring or the like. Furthermore, a second locking recess 10 could here also be provided, so that the bar is not only maintained in locking position after a tilting backwardly, but also, like in the first exemplary embodiment, after a forward tilting.

Figure 7:
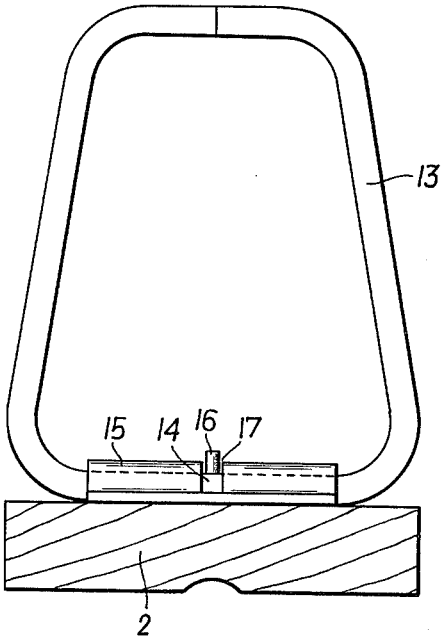
FIGS. 7 and 8 are also associated views of a different embodiment.
Figure 8:
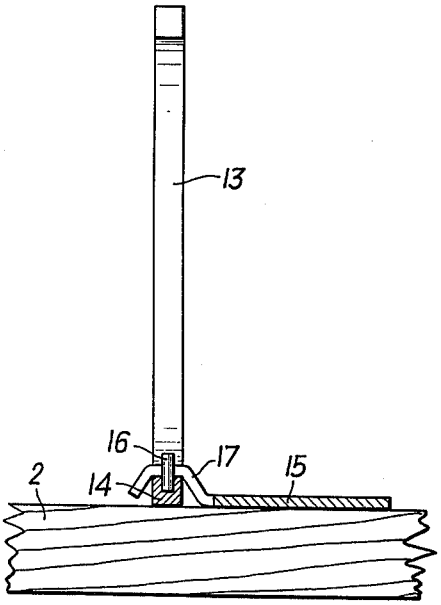

In FIGS. 7 and 8, the bar 13 has, differing from the preceding exemplary embodiments, a square cross section and forms practically a closed ring. Where this ring closes principally does not make any difference. In the exemplary embodiment, the closing point is illustrated in the center in the upper area. The closing point may be formed by having the ends abut. However, a welding, soldering, gluing together or the like is also a possibility. The web 14 of the bar 13, which web rests on the ski 2, is gripped over by a leaf spring 15 which is secured to the ski 2. By having the upper surface of the web 14 rest on the leaf spring 15, the bar is held in its illustrated position. After pivoting the bar 13, the leaf spring engages one of the side surfaces of the web 14 and thus holds the bar in engagement with the ski surface. To guide and hold the bar 13 in the center of the ski, a pin 16 is anchored to the web 14 and is guided in a slot 17 in the leaf spring 15. It would also be possible to use a bar having a round cross section and to provide at least one flat portion thereon, which, when the bar is positioned vertically, engages either the leaf spring or the ski surface. Although particular preferred embodiments of the invention have been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. An anti-crossing device for a ski having ski binding means mounted on the upper surface thereof, comprising:

a member pivotally secured to the upper surface of said ski between said ski binding means and the tip end of said ski, said member being pivotal between a first upright position transverse to the upper surface of said ski and a second collapsed position parallel to said ski, said member being sufficiently rigid to stand upright on said ski when in said first position;

means for limiting the extent of pivoting of said member relative to said ski so that said member will, in said second position, remain above the upper surface of said ski; and holding means for holding said member in at least said first position.

2. An anti-crossing device according to claim 1, wherein said member has a width no greater than the width of said skis.

3. An anti-crossing device according to claim 1, wherein said member is a bar which has an inverted U-shaped portion projecting above said upper surface of said ski when said bar is in said first position, the upper bight portion of said inverted U-shaped portion defining said means for limiting the extent of pivoting of said bar so that said bar in said second position will remain above said upper surface of said ski.

4. An anti-crossing device according to claim 3, wherein said bar has horizontally aligned bent ends adjacent said upper surface of said ski and includes bearing means mounted on said upper surface of said ski to receive said bent ends to thereby define a horizontally aligned pivot axis for said bar.

5. An anti-crossing device according to claim 4, wherein said pivot axis is perpendicular to the longitudinal axis of said ski.

6. An anti-crossing device according to claim 4, wherein said holding means comprises groove means in a laterally facing surface on said bearing means for receiving a portion of said bar, said groove means being aligned to positions corresponding to said first and second positions.

7. An anti-crossing device according to claim 6 including a spring engaging the legs of said bar to resiliently hold said bent ends into said groove means in said bearing means.

8. An anti-crossing device according to claim 4, wherein said bar has a circular cross section; and wherein said holding means includes means defining recesses in each of said bent ends of said bar, a pair of detent members and resilient means for urging each of said detent members into one of said recesses.

9. An anti-crossing device according to claim 8, wherein said bar is formed of a resilient material.

10. An anti-crossing device according to claim 3, wherein said holding means includes at least one locking recess in said bar into which is received at least one spring loaded locking element loaded by a spring.

11. An anti-crossing device according to claim 3, wherein said bar has at least one flat portion and said holding means includes a leaf spring secured to said upper surface of said ski and grips over said flat portion of said bar.

12. An anti-crossing device according to claim 11, wherein said leaf spring forms simultaneously a pivot bearing for said bar.

* * * * *